US006938808B1

(12) United States Patent
Potter

(10) Patent No.: US 6,938,808 B1
(45) Date of Patent: Sep. 6, 2005

(54) METHOD OF OPENING A BOX

(75) Inventor: David S. Potter, 6672 Partridge Cir., Gladstone, OR (US) 97027

(73) Assignee: David S. Potter, Clackamas, OR (US)

( * ) Notice: Subject to any disclaimer, the term of this patent is extended or adjusted under 35 U.S.C. 154(b) by 0 days.

(21) Appl. No.: 10/464,719

(22) Filed: Jun. 17, 2003

Related U.S. Application Data

(60) Provisional application No. 60/389,587, filed on Jun. 18, 2002.

(51) Int. Cl.[7] ..... B67B 7/00

(52) U.S. Cl. ..... 225/1; 225/93; 53/382.1; 53/492

(58) Field of Search ..... 225/1, 2, 93, 103, 225/104; 7/151, 166; 30/2, 414, 443, 444; 53/50, 382.1, 458, 468, 492; 81/3.47, 3.48, 81/3.49

(56) References Cited

U.S. PATENT DOCUMENTS

| | | | | |
|---|---|---|---|---|
| 2,896,318 A | * | 7/1959 | Brown | 30/2 |
| 3,130,884 A | * | 4/1964 | Lintz | 225/93 |
| 4,371,021 A | * | 2/1983 | Converse et al. | 7/151 X |
| 4,398,314 A | * | 8/1983 | Converse et al. | 7/151 |
| 5,899,372 A | | 5/1999 | Rodriguez | 225/1 |

* cited by examiner

*Primary Examiner*—Clark F. Dexter
(74) *Attorney, Agent, or Firm*—Law Office of Timothy E. Siegel; Timothy E. Siegel

(57) ABSTRACT

A box opener that includes a shaft extending along a longitudinal dimension. The shaft supports a box broaching wedge, operatively supported by the end of the shaft. The wedge narrowing from a base that is at least 2 cm (0.79 in) in dimension transverse to the longitudinal dimension of the shaft to a blunt edge spaced from the base by at least 2 cm (0.79 in).

2 Claims, 4 Drawing Sheets

METHOD OF OPENING A BOX

RELATED APPLICATIONS

The present application claims priority from provisional application Ser. No. 60/389,587, filed Jun. 18, 2002.

BACKGROUND OF THE INVENTION

The problem of opening boxes of syrup for use in soda fountains is one that was recognized in U.S. Pat. No. 5,899,372. These boxes contain a plastic bag filled with syrup. The general term for this type of container is a "bag-in-box," abbreviated as "BIB." Referring to FIG. 1 of the present application, at one end of this type of a box 2 there is a perforated, U-shaped seam 4, defining a flap 6. Underneath the flap 6 is the tube for connecting the syrup box to the receptive soda fountain hardware.

The person tasked with opening the box, typically a young employee with little experience, cannot use a utility knife because there is a great likelihood that in doing so the plastic bag holding the syrup would be sliced open, creating a mess for all involved. Typically the young employee punches the perforated seam with his or her fist and or knuckles, potentially injuring his or her hand and giving rise to an expensive worker's compensation claim.

U.S. Pat. No. 5,899,372 ('372) discloses a tool adapted for opening syrup boxes. Unfortunately, the patent discloses a tool made largely of stainless steel that is welded together, an expensive production technique that would result in a sales price unlikely to appeal to the operator of a fast food establishment working on a slim margin. Moreover, the tool itself appears to have an unfortunate design that would not facilitate the broaching of a syrup box to the extent necessary or desirable in a hand tool. Lip 28 does not appear to protrude outwardly from the base by more than about a centimeter, which would not appear to be enough to affirmatively tear the box apart at the seam. For whatever reason the tool disclosed in the '372 patent does not appear to have achieved widespread distribution.

SUMMARY

In a first separate aspect, the present invention is a box opener that includes a shaft extending along a longitudinal dimension. The shaft supports a box broaching wedge, operatively supported by the end of the shaft. The wedge narrowing from a base that is at least 2 cm (0.79 in) in dimension transverse to the longitudinal dimension of the shaft to a blunt edge spaced from the base by at least 2 cm (0.79 in).

In a second separate aspect, the present invention is a method of doing business, comprising distributing inexpensive, polymer injection molded box openers. Each of the box openers includes a shaft extending along a longitudinal dimension and having an end. A box broaching wedge is supported by the end of the shaft. The wedge narrows from a base to a blunt edge.

In a third separate aspect, the present invention is a method of opening a box having a perforated seam defining a flap. The method makes use of a box opener that includes a shaft extending along a longitudinal dimension and that supports a box broaching wedge. The wedge includes a slanted side wall and a blunt edge. The box opener is held so that the blunt edge is aligned with the seam and the slanted side wall is over the flap. The box opener is then pushed inwardly so that the edge breaks the seam and the slanted side wall pushes inwardly against the flap.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
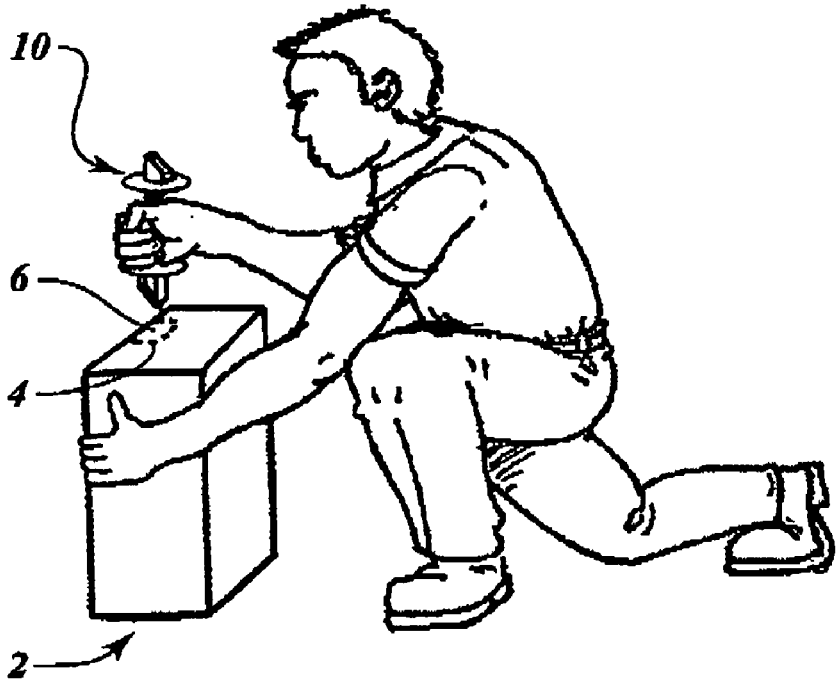
FIG. 1 is a perspective view of a prior art soda fountain syrup box, showing a person equipped with a box opener according to the present invention, engaged in the act of opening the box.

In a preferred embodiment the present invention is a box opener 10 that includes a shaft 12 that terminates in a first stop wall 14 and a second stop wall 16. In turn, first stop wall 14 supports a first opening wedge 18 and the second stop wall 16 operatively supports a second opening wedge 20.

Figure 6:
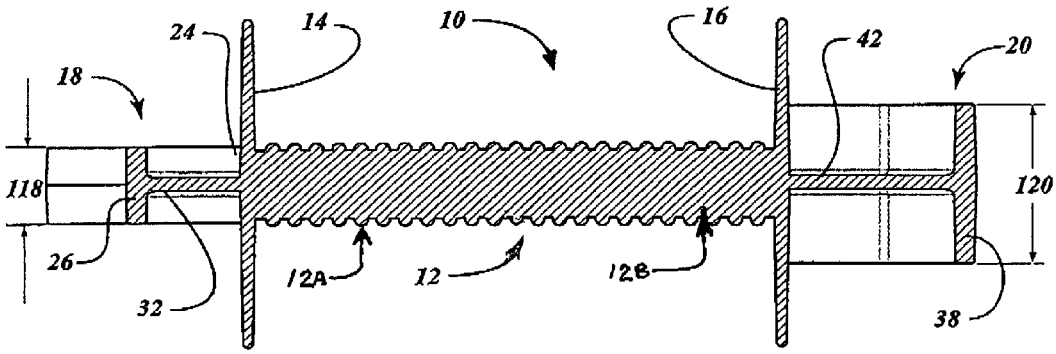
FIG. 6 is a cross-sectional view of the box opener of FIG. 3, taken along line 6—6 of FIG. 4.
Figure 7:
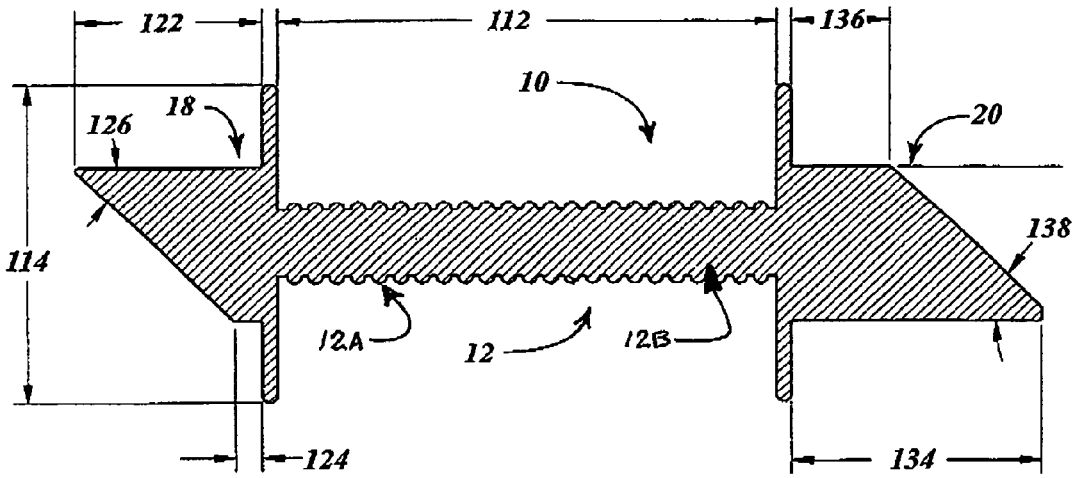
FIG. 7 is a cross-sectional view of the box opener of FIG. 3, taken along line 7—7 of FIG. 5.

The first opening wedge 18 has a width 118 (see FIGS. 6 and 7 for definitions of dimension) of about 1.8 cm (0.7 in) and includes a first long side wall 22, having a length 122 of about 3 cm (1.18 in), a first short side wall 24 has a length 124 of about 7 mm (0.28 in) and a first slanted side wall 26, which meets side wall 22 at an angle 126 of 45° to form a first blunt edge 28. A first interior support wall 32, provides support to first opening wedge 18.

The second opening wedge 20 has a width 120 of about 2.6 cm (1.02 in) and includes a second long side wall 34 having a length 134 of about 5.5 cm (2.2 in) and a second short side wall 36 having a length 136 of about 2.3 cm (0.91 in). A second slanted side wall 38 extends from second short side wall 36 to form an angle 138 of 45° with the second long side wall 34, at a second blunt edge 40. A second interior support wall 42 provides structural support to the second opening wedge 20.

In a preferred embodiment the second blunt edge 40 is 2 mm (0.78 in) thick. A sharper second blunt edge 40 would also fall within the scope of the invention, however. Edges 28 and 40 must be sufficiently blunt that neither one will cut through the plastic liner of a syrup box.

Box opener 10 may be injection molded from a polymeric resin. Using this technology, it is actually quite difficult to obtain an edge sharp enough to cut through the lining of a syrup box.

Both stop walls 14 and 16 are round, have a diameter 114 of about 7.6 cm (3 in) and are about 1 mm (0.04 in) thick. The shaft 12 has a length 112 of about 11.1 cm (4.4 in) and includes ribs 12A for ease of grasping by a user. In one preferred embodiment, the interior 12B of shaft 12 forms a cross in transverse dimension, for added transverse strength.

Figure 2:
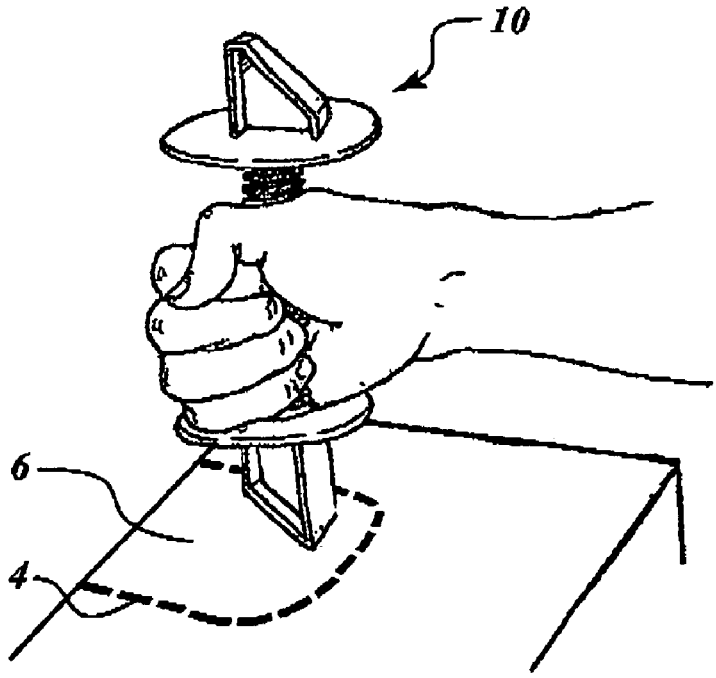
FIG. 2 is a partial expanded view of the soda fountain syrup box, the box opener and person of FIG. 1.
Figure 3:
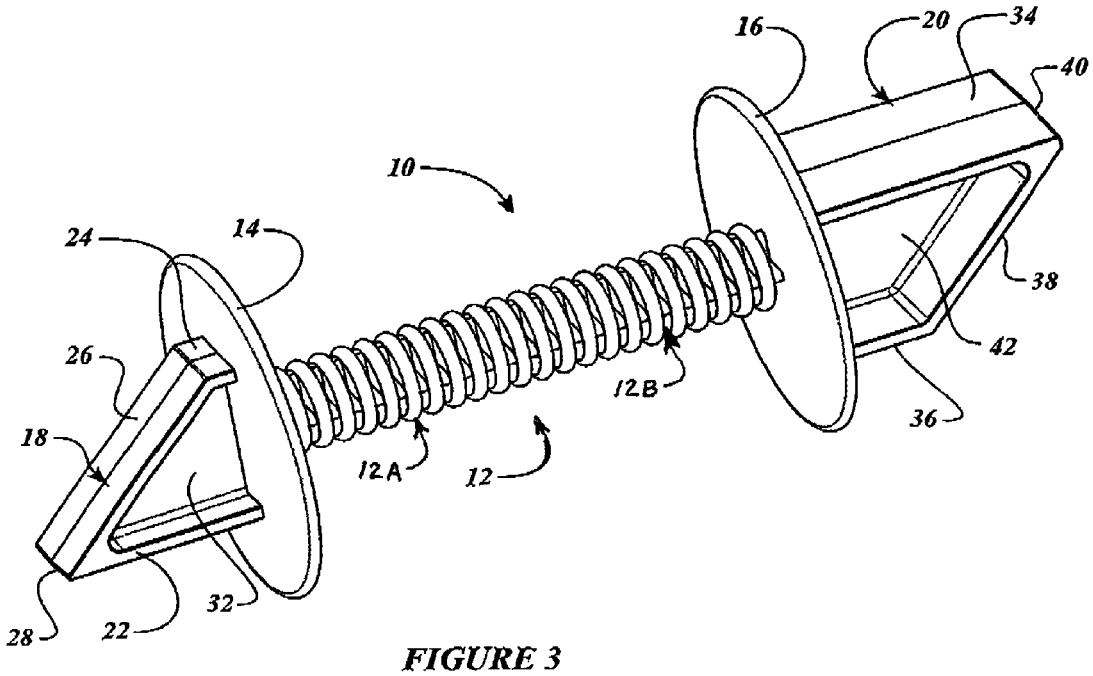
FIG. 3 is a perspective view of a box opener according to the present invention.
Figure 4:
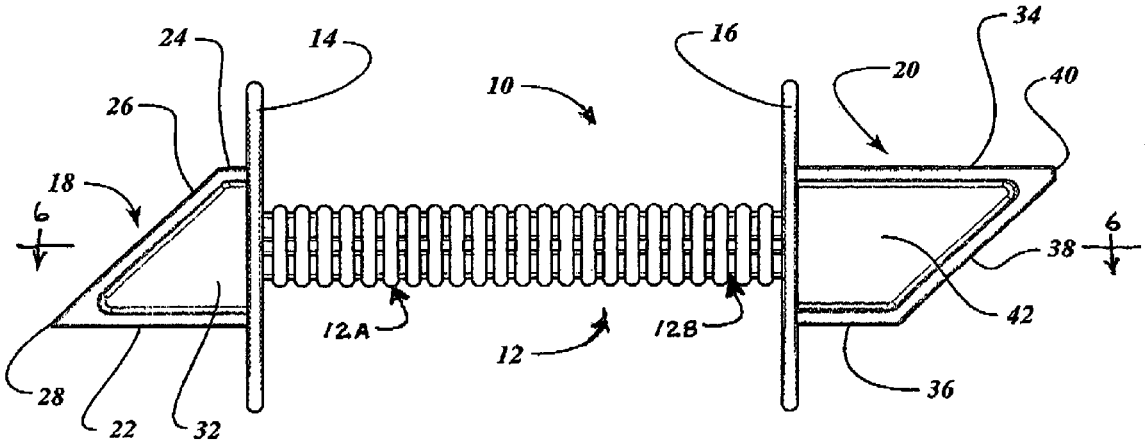
FIG. 4 is a side view of the box opener of FIG. 3.
Figure 5:
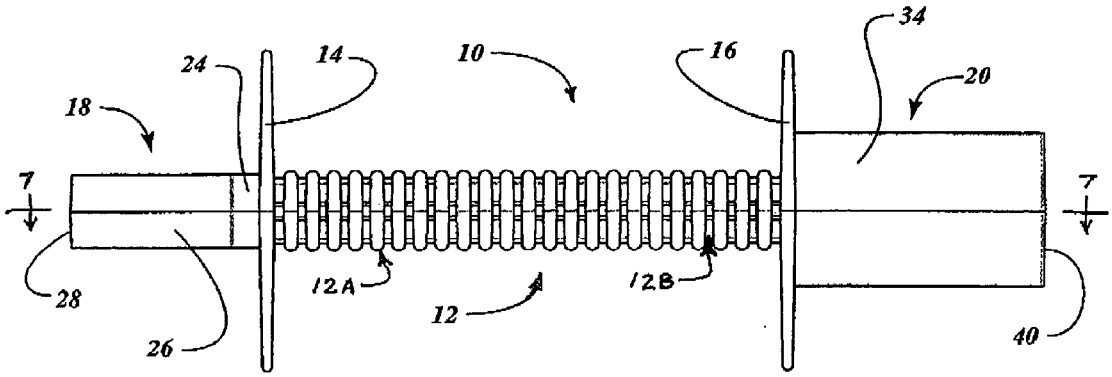
FIG. 5 is a top view of the box opener of FIG. 3.

The advantages of box opener 10 should now be readily apparent. As noted in the Background section and as shown in FIGS. 1 and 2, syrup boxes 2 have a perforated seam 4 in the form of a shallow U, defining a flap 6. A person who desires to open a syrup box may take the box opener 10, grasp it by the shaft 12, align the first blunt edge 28 with the perforated seam 4 and orient box opener 10 so that the first slanted side wall 24 is positioned over the flap 6. If the person then pushes down, the first slanted side wall 26 will push the flap 6 inwardly as edge 28 breaks the seam. This same exercise may then be repeated with the second opening wedge 20, to increase the size of the seam 4 breakage and push a larger portion of the flap 6 inward.

Because box opener 10 is an injection molded polymer device, it can be produced inexpensively, relative to prior art devices. Accordingly, it can be offered at a price that would make it attractive to beverage vendors who could distribute it for free or for a very small charge and for restaurants having soda fountains to provide to their employees to avoid the expense of worker's compensation claims and ease one of the many tasks faced by their employees.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of opening a box having a perforated seam defining a flap, comprising:

(a) providing a box opener, including:

(i) a shaft extending along a longitudinal dimension and having an end; and (ii) a box broaching wedge, supported by said end of said shaft, said wedge including a slanted side wall and a blunt edge;

(b) holding said box opener so that said blunt edge is aligned with said seam and said slanted side wall is over said flap; and (c) pushing said box opener inwardly into said box so that said edge breaks the seam and said slanted side wall pushes inwardly against said flap; wherein said shaft includes a second end and wherein a second box broaching wedge is supported by said second end of said shaft, said second box broaching wedge being larger than said box broaching wedge, and pushing said second box broaching wedge inwardly into said box to increase said breakage of said seam after the usage of said box broaching wedge.

2. A method of opening a box having a perforated seam defining a flap, comprising:

(a) providing a box opener, including:

(i) a shaft extending along a longitudinal dimension and having an end; and (ii) a box broaching wedge, supported by said end of said shaft, said wedge including a slanted side wall and a blunt edge;

(b) holding said box opener so that said blunt edge is aligned with said seam and said slanted side wall is over said flap; and (c) pushing said box opener inwardly into said box so that said edge breaks the seam and said slanted side wall pushes inwardly against said flap; further including a stop wall positioned between said box broaching wedge and said shaft, said stop wall extending transversely outwardly from said shaft and extending outwardly farther than said wedge at least in a transverse direction corresponding to the slanted side wall, and pushing said box broaching wedge inwardly into said box up to said stop wall.

* * * * *